US005657295A

United States Patent [19]

Howard

[11] Patent Number: 5,657,295

[45] Date of Patent: Aug. 12, 1997

[54] ULTRASONIC TRANSDUCER WITH ADJUSTABLE ELEVATIONAL APERTURE AND METHODS FOR USING SAME

[75] Inventor: Samuel M. Howard, Mountain View, Calif.

[73] Assignee: Acuson Corporation, Mountain View, Calif.

[21] Appl. No.: 564,424

[22] Filed: Nov. 29, 1995

[51] Int. Cl.[6] ..... H04R 1/44

[52] U.S. Cl. ..... 367/140

[58] Field of Search ..... 367/140, 153; 310/320, 334; 128/662.03, 660.1

[56] References Cited

U.S. PATENT DOCUMENTS

| | | | |
|---|---|---|---|
| 4,184,094 | 1/1980 | Kopel | 367/152 |
| 4,205,686 | 6/1980 | Harris et al. | 310/336 |
| 4,550,607 | 11/1985 | Muslak et al. | 73/626 |
| 4,677,981 | 7/1987 | Coursant | 310/358 |
| 4,686,408 | 8/1987 | Ishiyama | 310/334 |
| 4,735,096 | 4/1988 | Dorr | 310/325 |
| 4,736,631 | 4/1988 | Takeuchi et al. | 73/649 |
| 5,097,709 | 3/1992 | Masuzawa et al. | 128/661.01 |
| 5,163,436 | 11/1992 | Saitoh et al. | 128/662.03 |
| 5,345,139 | 9/1994 | Gururaja et al. | 310/358 |
| 5,396,143 | 3/1995 | Seyed-Bolorforsh et al. | 128/662.03 |
| 5,410,205 | 4/1995 | Gururaja | 310/328 |
| 5,415,175 | 5/1995 | Hanafy et al. | 28/662.03 |
| 5,435,314 | 7/1995 | Dias | 128/660.1 |
| 5,438,554 | 8/1995 | Seyed-Bolorforsh et al. | 367/140 |
| 5,438,998 | 8/1995 | Hanafy | 128/662.03 |

FOREIGN PATENT DOCUMENTS

0682989 A2 9/1994 European Pat. Off. .

OTHER PUBLICATIONS

T. Shrout et al., "Relaxor Ferroelectric Materials," *IEEE 1990 Ultrasonics Symposium*, pp. 711–720 (1990).

M. Takeuchi et al., "Medical Ultrasonic Probe Using Electrorestrictive–Ceramics/Polymer Composite," *IEEE 1989 Ultrasonics Symposium*, pp. 705–708 (1989).

D. Damjanovic et al., "Electrorestrictive and Piezoelectric Materials for Actuator Applications," *J. of Intell. Mater. Syst. and Struct.*, vol. 3, pp. 190–208 (Apr. 1992).

H. Masuzawa et al., "Electrorestrictive Materials for Ultrasonic Probes in the Pb $(Mg_{1/3}Nb_{2/3})O_3$—$PbTiO_3$ System," *Japanese Journal of Applied Physics*, vol. 28, pp. 101–104 (1989).

*Primary Examiner*—Daniel T. Pihulic

*Attorney, Agent, or Firm*—Brinks Hofer Gilson & Lione

[57] ABSTRACT

An ultrasound transducer includes transducer segments having a non-uniform thickness layer of relaxor ferroelectric material and coupled to a source of biasing voltage thereto. The elevational aperture is controlled by varying biasing voltage applied to the layer of relaxor ferroelectric material.

19 Claims, 7 Drawing Sheets

FIG. 6
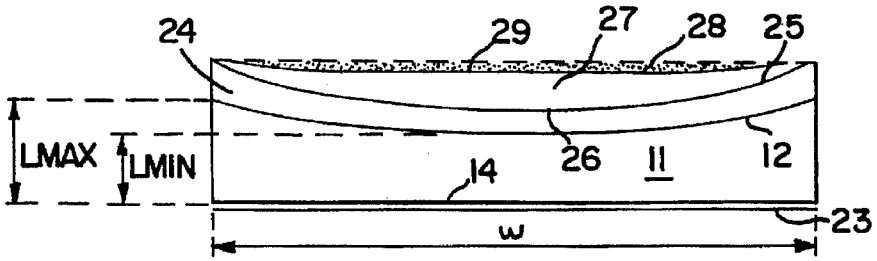
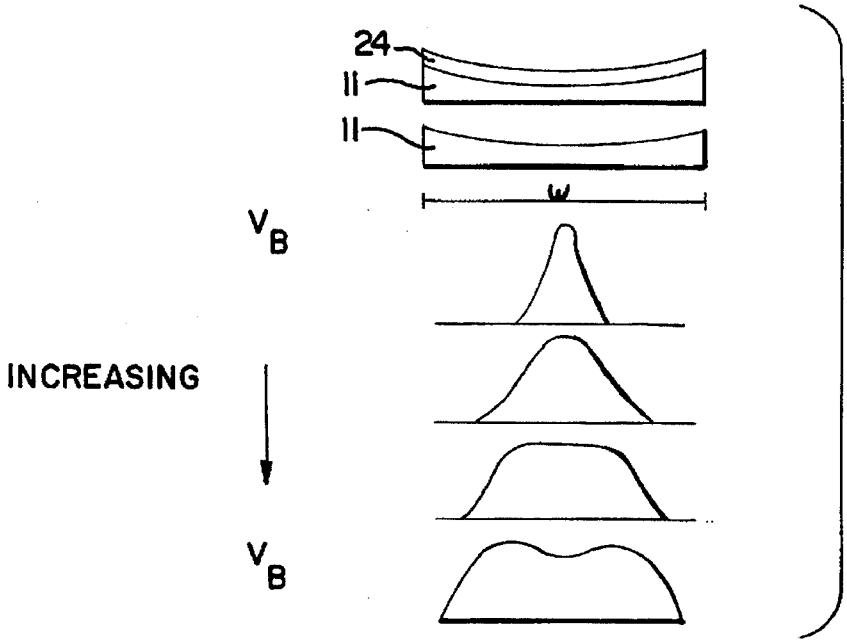
FIG. 7
FIG. 8a
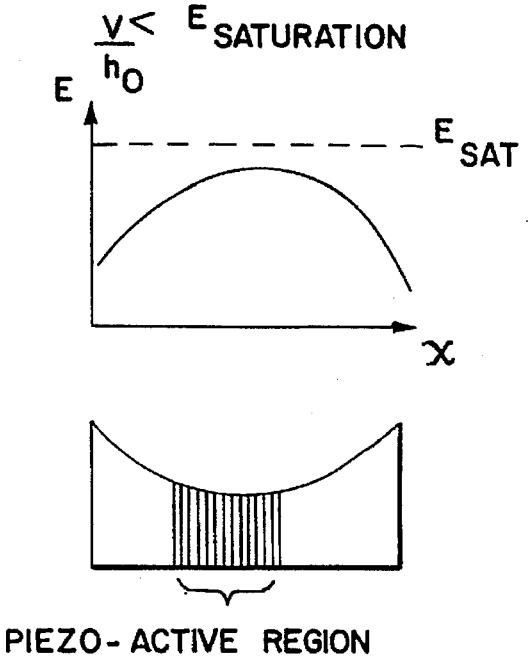
FIG. 8b
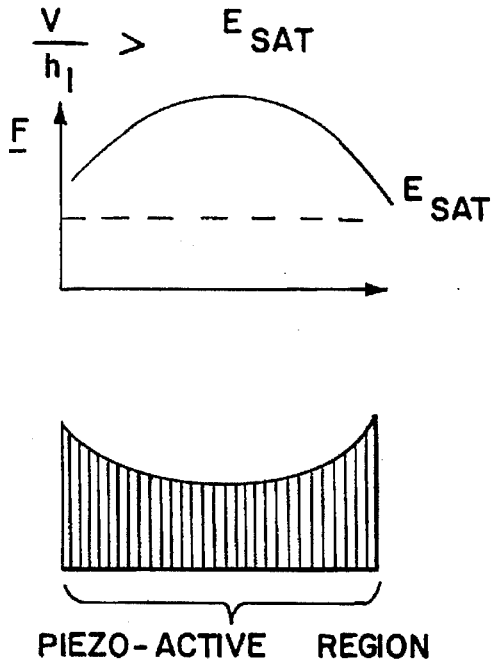

ULTRASONIC TRANSDUCER WITH ADJUSTABLE ELEVATIONAL APERTURE AND METHODS FOR USING SAME

FIELD OF THE INVENTION

This invention relates to transducers and more particularly to broadband phased array transducers for use in the medical diagnostic field.

Ultrasound machines are often used for observing organs in the human body. Typically, these machines contain transducer arrays for converting electrical signals into pressure waves. Generally, the transducer array is in the form of a hand-held probe which may be adjusted in position to direct the ultrasound beam to the region of interest. Transducer arrays may have, for example, 128 transducer segments or elements for generating a steerable ultrasound beam in order to image a sector slice of the body.

Electrical contact is made to the front and rear surface of each transducer element for individually exciting and receiving from each element, where the front surface is that surface facing the region of examination and the rear surface is opposite to the front surface. The pressure waves generated by the transducer elements are directed toward the object to be observed, such as the heart of a patient being examined. The steering of the beam in the plane of electronic scanning, i.e., the image plane, is done in real time by computer generated time delays. Each time a pressure wave confronts a tissue interface having different acoustic impedance characteristics, a wave is reflected backward. The array of transducer segments may then likewise convert the reflected pressure waves into corresponding electrical signals. An example of a phased array acoustic imaging system is described in U.S. Pat. No. 4,550,607 granted Nov. 5, 1985 to Maslak et al. That patent illustrates circuitry for combining the incoming signals received by the transducer array to produce a focused image on the display screen.

The dimension of a phased array transducer orthogonal to the electronically scanned azimuthal plane is referred to as the elevational dimension or axis. There is normally only nonelectronic passive focusing in this slice-thickness dimension.

The elevation focusing of most phased array transducers can generally be categorized as lens focused or mechanically focused. With regard to lens focused transducer arrays, the emitting surface of the array is flat in the elevation direction and a shaped material, the lens, is placed between the object to be imaged and the array. The lens material has a different velocity of sound than the object being imaged. The elevational focusing of the ultrasound beam is achieved through refraction at the lens/object interface. U.S. Pat. Nos. 4,686,408 and 5,163,436 describe lens focused phased array transducers. The material used to form the lens is typically silicone based and, unfortunately, also has the undesirable property of absorbing or attenuating ultrasound energy and thereby reducing the overall sensitivity of the transducer array.

Mechanically focused transducer arrays generally have utilized a piezoelectric layer which has a curved surface designed to face the region of examination. The surface is curved along the elevation direction and forms either a concave or convex structure. U.S. Pat. Nos. 4,184,094 and 4,205,686 describe such mechanically focussed transducer arrays.

U.S. Pat. Nos. 5,415,175 and 5,438,998 ("the '175 and '998 patents") which are specifically incorporated herein by reference also disclose a mechanically focused broadband phased array transducer. The transducer in the '175 and '998 patents has a layer of piezoelectric material with a non-uniform thickness. In a preferred embodiment, the thickness of the layer is at a minimum in the center region of the layer and increases to a maximum thickness away from the center region. Varying the thickness of the layer of piezoelectric material produces a variation in the electric field throughout the layer. The beam width or aperture along the elevation direction varies depending upon the signal frequency applied to the layer of piezoelectric material. At high frequencies, the beam has a narrower aperture. At low frequencies, the beam has a wider aperture.

FIG. 1A illustrates a transducer element formed of piezoelectric material according to the '175 and '998 patents. An excitation signal V is applied to the layer. FIG. 1B illustrates the relationship between apodization or electric field intensity and the thickness of the transducer segment. It can be seen that the apodization or electric field intensity is inversely proportional to the thickness of the layer 10. Thus, as one moves away from the central region of the transducer element, the energy decreases as the thickness of the layer increases. The degree to which the apodization may be varied is, however, fixed by the geometry of the layer of piezoelectric material.

U.S. Pat. No. 5,345,139 which is specifically incorporated herein by reference discloses a medical ultrasonic imaging probe. The probe includes a layer of relaxor ferroelectric material of uniform thickness (element 7, FIG. 14). The aperture of the probe may be varied by a bias voltage applied across the layer. U.S. Pat. No. 5,396,143 discloses a medical ultrasonic imaging transducer with elevation aperture control. In particular, the transducer includes a layer of relaxor ferroelectric material of uniform thickness (element 12, FIG. 1). A layer of dielectric material 18 is disposed on the layer of relaxor material. The layer of dielectric material 18 is not uniform in thickness but rather has a thickness which increases away from the central region of the transducer element. The elevation aperture is dynamically controlled by controlling the strength of the electric field applied across the layer of relaxor ferroelectric material. The changes in thickness of the dielectric layer provide different potential drops across the dielectric material which affect the elevation aperture. Using a tapered dielectric layer, however, requires an extra layer thereby complicating the manufacture of the transducer. Also, an extra layer introduces an extra bondline thereby making the manufacture of such a transducer more difficult and more prone to variations which can cause inaccuracies.

It is thus desirable to provide a transducer design having a greater flexibility for varying the elevational apodization of the transducer while providing a simple and uncomplicated design to manufacture.

It is also desirable to provide a transducer design wherein the elevational aperture can be selectively adjusted.

It is also desirable to provide a transducer design which provides great flexibility for varying the elevational apodization while not introducing extra layers or band lines.

SUMMARY OF THE INVENTION

According to a first aspect of the present invention there is provided a transducer array having a layer of relaxor ferroelectric material with a front surface and a back surface and a thickness. The thickness is defined as the distance perpendicular to an elevational axis between the front surface and the back surface. The layer thickness at a first point on the front surface is less than the layer thickness at a second point on the front surface. The front surface faces a medium of interest when said transducer is in use. A source of a bias voltage is coupled to said layer of relaxor ferroelectric material.

According to a second aspect of the present invention, there is provided a method of controlling an elevational aperture of a transducing device. The method includes the steps of providing a layer of relaxor ferroelectric material having a first side and a second side, opposite to the first side. The layer increases in thickness with departure from a central region of the first side. Electrodes are provided on the first and second sides of the layer of relaxor ferroelectric material. A bias voltage is applied across the layer to align dipoles of the layer, thereby providing local variations in degrees of alignment of dipoles in correspondence with variations in thickness of the layer. Acoustic waves are transmitted from the transducing device into a medium of interest by applying an excitation signal across the layer. The bias voltage is selectively changed to vary the alignment of dipoles of the layer thereby changing an elevation aperture of the transducing device such that the penetration depth into the medium of interest and beam characteristics of the acoustic wave transmission vary.

According to a third aspect of the present invention, there is provided a device for transmitting and receiving acoustic waves. The device includes a transducer having a layer of relaxor ferroelectric material having a first side and a second side opposite the first side. The layer of relaxor ferroelectric material increases in thickness with departure from a central region of the first side. First and second electrodes are formed on the first and second sides of the layer of relaxor ferroelectric material. A first source of excitation signal is connected to the first and second electrodes. A second source of a biasing voltage is connected to the first and second electrodes wherein degrees of polarization of the layer of relaxor ferroelectric material are varied spatially in correspondence to changes in thickness of the layer of relaxor ferroelectric material and wherein the transducer has an effective elevation aperture that varies in response to changes in the biasing voltage from the second source.

BRIEF DESCRIPTION OF THE DRAWINGS

FIG. 6 is a cross-sectional view taken in the elevation direction of a portion of a single broadband transducer element of the transducer array shown in FIG. 3.

FIG. 7 is a view of the exiting beam width produced by the broadband transducer elements with variations in the applied bias voltage.

FIGS. 8*a* and 8*b* are diagrams illustrating the variation in active piezoelectric regions in a layer of relaxor ferroelectric material of non-uniform thickness with variation in the applied bias voltage.

DETAILED DESCRIPTION OF THE PRESENTLY PREFERRED EMBODIMENTS OF THE PRESENT INVENTION

Figure 1A:
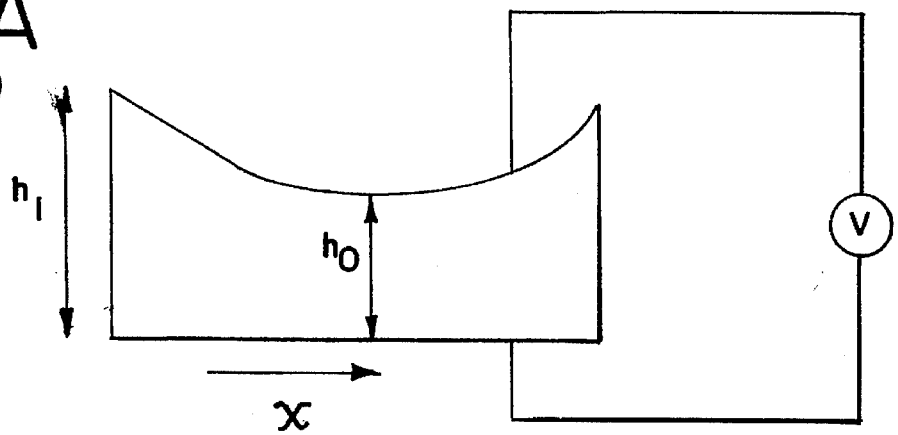
FIG. 1A (PRIOR ART)
FIG. 1A is a schematic illustrating a prior art variable thickness transducer element with an excitation source.
Figure 1B:
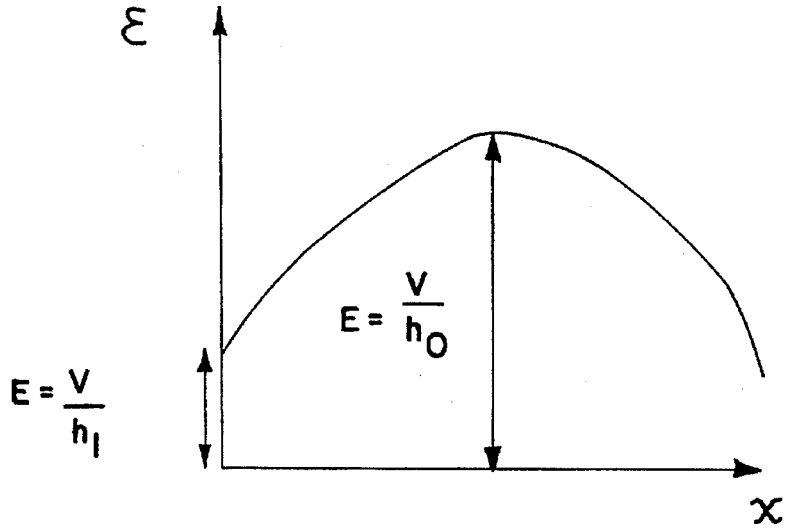
FIG. 1B (PRIOR ART)
FIG. 1B is a graph illustrating the variation in apodization with the variation in thickness of the prior art transducer element shown in FIG. 1A.
Figure 2:
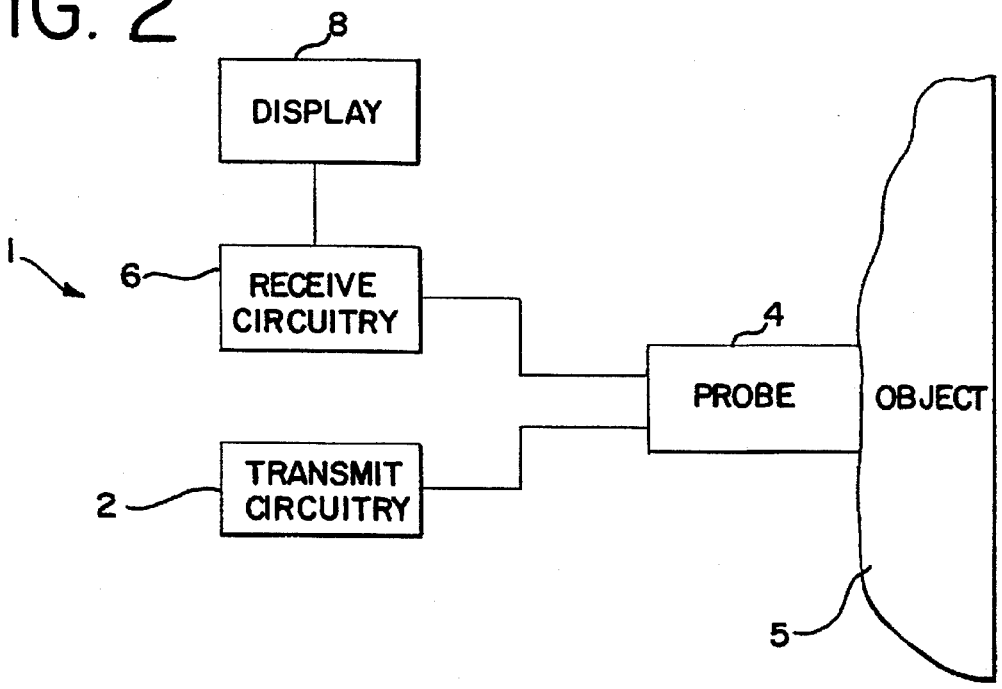
FIG. 2 is a schematic view of an ultrasound system for generating an image of an object or body being observed.

FIG. 2 is a schematic of an ultrasound system 1 for generating an image of an object or body 5 being observed. The ultrasound system 1 includes transmit circuitry 2 for transmitting electrical signals to the transducer probe 4, receive circuitry 6 for processing the signals received by the transducer probe 4, and a display 8 for providing the image of the object 5 being observed.

Figure 3:
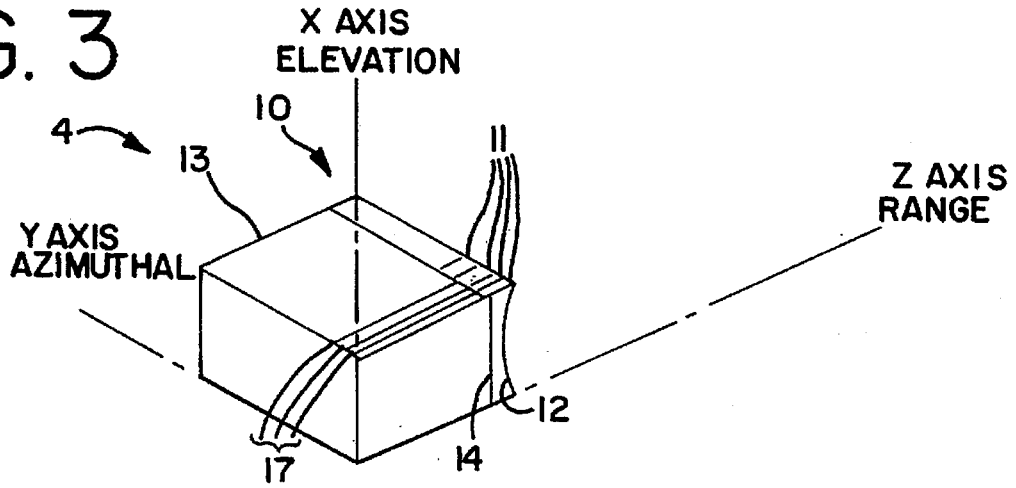
FIG. 3 generally illustrates a transducer array for transmitting and receiving an ultrasound bean.

FIG. 3 generally illustrates a transducer array 10 for transmitting and receiving an ultrasound beam. The indicated x, y and z directions are referred to as the elevational, azimuthal, and range directions respectively. Typically, there are one hundred twenty eight elements 11 in the azimuthal dimension forming the broadband transducer array 10. However, the array can consist of any number of transducer elements 11 each arranged in any desired geometrical configuration. The transducer array 10 is supported by a backing block 13. The structure of the probe 4 will be described in greater detail with reference to FIG. 6.

The probe 4 may be hand-held and can be adjusted in position to direct the ultrasound beam to the region of interest. The transducer elements 11 convert the electrical signals provided by the transmit circuitry 2 to pressure waves. The transducer elements 11 also convert the pressure waves reflected from the object 5 being observed into corresponding electrical signals which are then processed in the receive circuitry 6 and ultimately displayed on display 8.

Figure 4:
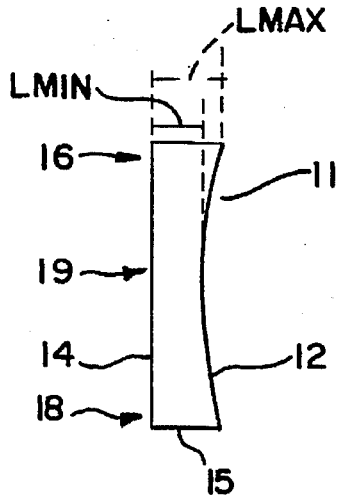
FIG. 4 is a cross-sectional view taken along the elevation direction of a transducer element shown in FIG. 3 according to a first preferred embodiment of the present invention.
Figure 5:
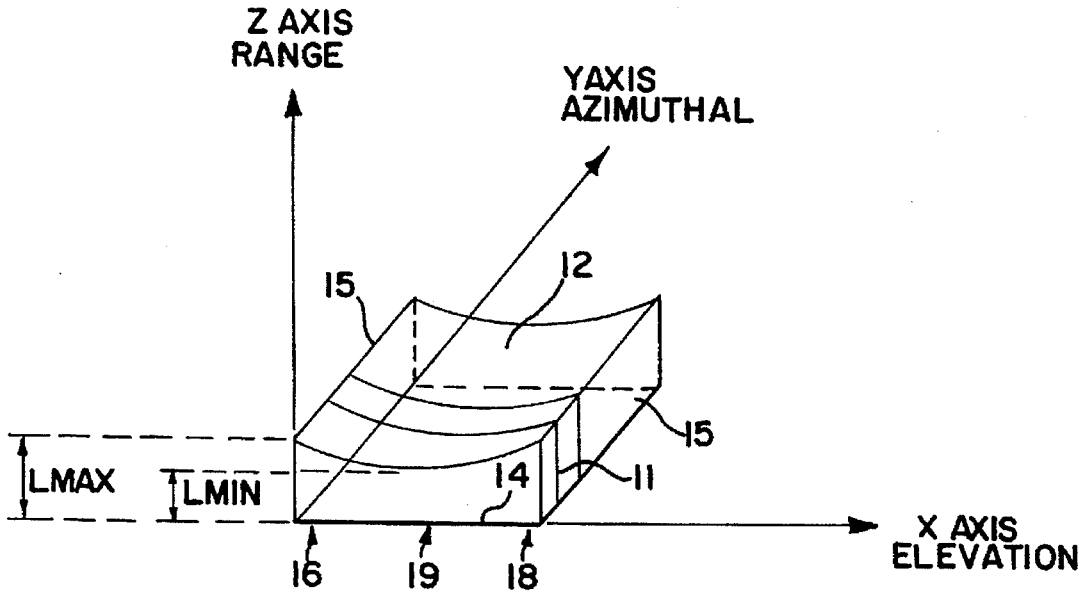
FIG. 5 is a perspective view of the broadband transducer array shown in FIG. 3 rotated 90°.

FIG. 4 is a cross-sectional view taken along the elevation direction of a transducer element 11 according to a first preferred embodiment of the present invention. FIG. 5 is a perspective view of the transducer probe 4 shown in FIG. 3 without the backing block rotated 90°. Transducer element 11 has a front surface 12, a back surface 14, a center region 19, and two side ends 16 and 18. The front surface 12 is the surface which is directed toward the region of examination. The back surface 14 may be shaped as desired, but is generally planar. The front surface 12, however, is generally a non-planar surface. Thus, in a preferred embodiment the element 11 has a plano-concave structure. The thickness of the element 11 is defined as the distance between the front surface 12 and the back surface 14 in a direction parallel with the range axis. The thickness of the element 11 is at a minimum $L_{MIN}$ at the center region 19 and increases towards the side ends 16 and 18 where it is at its maximum thickness $L_{MAX}$ (see FIG. 4). In such a configuration the radius of curvature along the elevation direction is different from the radius of curvature along the azimuthal direction as can be seen in FIG. 5.

Although the front surface 12 is illustrated as having a continuously curved surface, the front surface 12 may include a stepped configuration, a series of linear segments, or any other configuration wherein the thickness of element 11 is greater at each of the side ends 16 and 18 and decreases in thickness at the center region 19, resulting in a negatively "curved" front surface 12. The back surface 14 may be, alternatively, a concave or convex surface. Each of the side ends 16, 18 does not have to be of the same thickness and $L_{MIN}$ does not have to be in the exact center of the transducer element to practice the invention.

Figure 15:
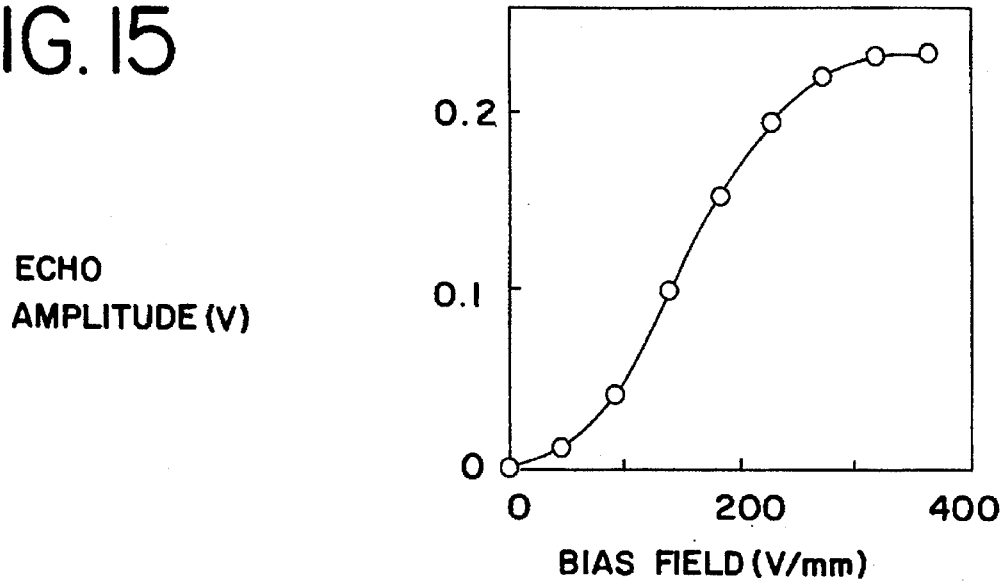
FIG. 15 is a graph illustrating echo amplitude versus bias field for a relaxor material.

Preferably, element 11 is composed of a material that exhibits an increase in its electromechanical coupling coefficient with an increase in the bias field applied to the material. FIG. 15 is a graph illustrating such a characteristic for a probe using 0.91 $Pb(Mg_{1/3}Nb_{2/3})$ $O_3$-0.09 $PbTiO_3$/polyurethane composite. One group of materials that exhibits such a characteristic are electrorestrictives such as relaxor ferroelectric materials. An electrostrictive material is one that is highly polarizable by application of a direct current (D.C.) bias voltage, and thus exhibits piezoelectric properties when biased. The electrostrictive material loses its polarization upon removal of the D.C. bias voltage and thus no longer exhibits piezoelectric properties. The following materials, for example, are suitable to form element 11: (1) PMN: lead magnesium niobate ($Pb(Mg_{1/3}Nb_{2/3})O_3$), (2) PMN-PT: lead magnesium niobate-lead titanate, or modified lead magnesium niobate ($Pb(Mg_{1/3}Nb_{2/3})O_3$ PLZT: (3) lanthanum-doped lead zironate titanate ($Pb(Zr_{0.65}$ $Ti_{0.035})$ $O_3$) or (4) BST: barium strontium titanate (Ba,Sr) $T_1O_3P_6TiO_3$).

U.S. Pat. Nos. 5,415,175 and 5,438,998 which have been specifically incorporated herein disclose various embodiments and dimensions of a variable thickness layer of piezoelectric material. The same or similar dimensions may be used in the present invention for the layer of relaxor ferroelectric material and thus need not be repeated here.

FIG. 6 is a cross-sectional view taken in the elevation direction of a portion of a single broadband transducer element of the transducer array shown in FIG. 3. A matching layer 24 is preferably disposed on the front surface 12 of the element 11. Electrodes 23 and 25 may be disposed on the back surface 14 of element 11 and front surface of matching layer 24, respectively, as is well known to those skilled in the art. The electrodes 23 and 25 may be deposited by well known techniques such as sputtering, for example. Alternatively, the matching layer 24 may be omitted and electrode 25 may be disposed directly on the front surface 12 of element 11. The electrodes 23 and 25 not only apply an excitation signal to element 11 but they also apply a bias voltage to the element 11 as will be described in detail hereinafter.

Electrode 23 is referred to as the hot electrode and preferably provides the excitation signal for exciting the respective transducer element. Electrode 25 may be ground. Referring to FIG. 3 leads 17 may be utilized to excite each of the electrodes 23 on the respective transducer elements 11. Electrodes 25 may all be connected to an electrical ground.

Alternatively, an interconnect circuit (not shown) may be used to provide the electrical excitation of the respective transducer elements. For example, electrode 25 may be a signal flex circuit and electrode 23 may be a ground flex circuit. These flex circuits are manufactured using well known combinations of conductive metallic foils and insulating films and generally consist of a single such conductive layer and at least one insulating layer such as KAPTON™. A typical flex circuit is manufactured using one-ounce copper foil which is coated or laminated to 0.001" insulating film of polyimide, such as KAPTON™. These layers can be individually patterned so that the signal flex circuit has an exposed lead for each transducer element in the array and a connection is made between the layer of ferroelectric material and the signal flex circuit. Similarly, connection is made between the layer of ferroelectric material and the ground flex circuit. Suitable flex circuits have been manufactured by Sheldahl of Northfield, Minn. The KAPTON™ layers insulate hot leads from ground leads where necessary and provide alignment guides and support. In a preferred embodiment, the portion of the signal flex circuit that is in contact with element 11 extends over the entire surface of the element 11. The electrodes or flex circuits may be bonded to element 11 by any of the techniques disclosed in the '175 or '998 patents.

FIG. 7 illustrates a typical variation in the exiting beam width or aperture along the elevation direction produced by the broadband transducer by the application of various bias voltages from low value to high value. At a low bias voltage VB, for example, about 50 volts, the beam has a narrow aperture. When the bias voltage is increased, the beam has a wider aperture. Further, at a high enough bias voltage, for example, about 200 volts, the beam is effectively generated from the full aperture of the transducer element 11. As shown in FIG. 7, at this high bias voltage the exiting pressure wave has two peaks, simulating the excitation of a wide aperture two-dimensional transducer array at lower frequencies. The value of the bias voltage needed to achieve a desired aperture is dependent upon the frequency at which the transducer is operated and the thickness of the layer of relaxor material.

By controlling the level of the applied bias voltage, the operator may control which section of transducer element 11 generates the ultrasound beam. That is, at low Voltages, the beam is primarily generated from the center of the transducer element 11 and at higher voltages, the beam is primarily generated from the full aperture of the transducer element 11. Further, the greater the curvature of the front surface 12, the more the element 11 simulates a wide aperture two-dimensional transducer array.

According to the present invention greater flexibility in adjusting the elevation aperture is provided by fabricating the transducer elements from relaxor ferroelectric material and controlling the bias voltage applied to the layer of relaxor ferroelectric material. As already described, because the transducer is fabricated from a relaxor ferroelectric material instead of a piezoelectric material, only portions of the layer that are biased become piezoactive and thus, ultrasonic waves are generated and received only by the selectively biased portions. Also, by varying the thickness of the relaxor material, the band width of the transducer is also increased as is the case for the non-uniform thickness piezoelectric layer described in the '175 and '998 patents.

FIGS. 8*a* and 8*b* are diagrams illustrating the variation in active piezoactive regions in a layer of relaxor ferroelectric material of non-uniform thickness with the variation in the applied bias voltage. In FIG. 8*a* when the applied bias voltage V divided by the center thickness $h_o$ of the layer is less than the saturation voltage E of the material, only the central region of the layer is active and thus, a beam having a narrow elevational aperture is emitted. In FIG. 8*b* when the applied bias voltage divided by the thickness $h_1$ of the layer at its side ends is greater than the saturation voltage of the material, the entire layer becomes piezoelectric active and thus, a wide beam in the elevational direction is emitted.

Figure 9:
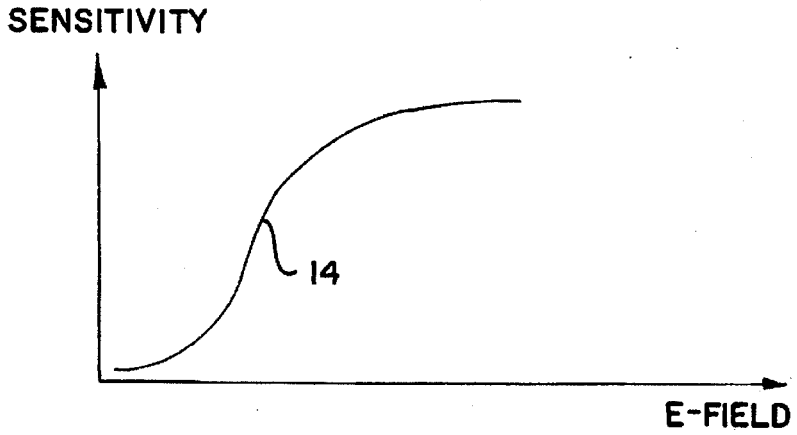
FIG. 9 is a graph illustrating the relationship between the sensitivity of a layer of relaxor ferroelectric material and the applied electric field.
Figure 10:
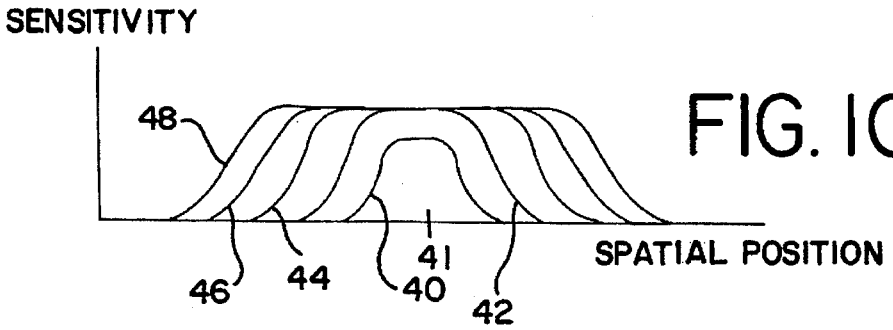
FIG. 10 is a graph illustrating the relationship between the sensitivity induced in a layer of relaxor ferroelectric material having non-uniform thickness and the size of the elevation aperture.

FIG. 9 is a graph illustrating the relationship between the sensitivity of a layer of relaxor ferroelectric material and the applied electric field. One can see that the sensitivity of a layer increases with an increase in the applied electric field. FIG. 10 is a graph illustrating the relationship between the sensitivity induced in a layer of relaxor ferroelectric material having non-uniform thickness and the size of the elevation aperture. A first plot 40 shows a sensitivity that does not reach saturation even at the central region 41 of the transducer. The sensitivity quickly falls off because the thicker regions of the layer prevent regions away from the central region 41 from becoming piezoelectrically active. That is, at the bias voltage that provides the plot 40, only a small degree of dipole alignment occurs within the relaxor ferroelectric layer.

A second plot 42 of FIG. 10 shows that as the bias voltage across the layer is increased, the piezoelectric activity at the central region of the ultrasonic transducer 10 reaches saturation and that the effective elevation aperture increases in size. Successive increases in the bias voltage generate plots 44, 46 and 48. In the final plot 48, some sensitivity is achieved even at the edges of the ultrasonic transducer. Moreover, a greater percentage of the transducer has reached the saturation level.

Figure 11:
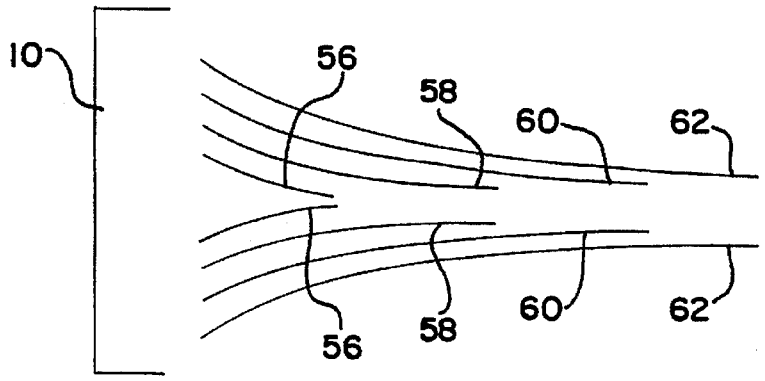
FIG. 11 illustrates the focusing of the emitted beam in the elevational direction for various levels of bias voltage.
Figure 12:
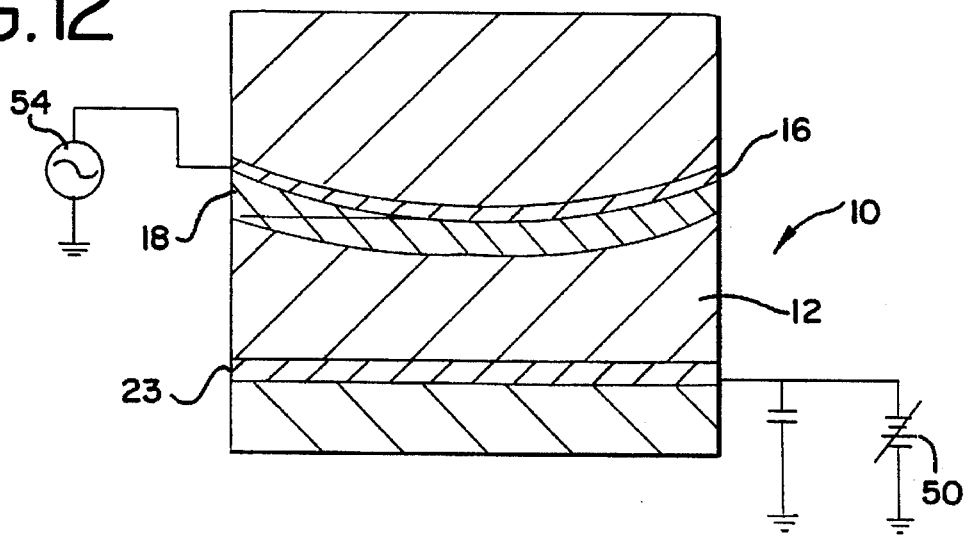
FIG. 12 is a cross-sectional view of a transducer element according to a preferred embodiment of the present invention.

FIG. 11 illustrates the focussing of the emitted beam in the elevational direction for various levels of bias voltage. FIG. 12 is a cross-sectional view of a transducer element according to a preferred embodiment of the present invention. The operation of the ultrasonic transducer will be described with reference to FIGS. 11 and 12. A variable source 50 of bias voltage is connected to second electrode 23. The first electrode 25 is connected to a source 54 of an excitation signal, together with receiver electronics. Alternatively, both the bias voltage source 50 and the excitation signal source 54 may be connected to the same electrode, with the other electrode being tied to ground potential. Also, the bias voltage source 50 may also be coupled to the receiver electronics and controlled thereby. In a preferred embodiment the bias voltage source 50 provides DC voltage and excitation signal source 54 provides an RF excitation signal.

Referring to FIG. 11, at a relatively low bias voltage, only the central region of the transducer becomes piezoelectrically active. As a result, an interrogation beam, represented by lines 56, has a limited penetration into a medium of interest, with a small beam diameter at shallow depths. Thus, the near-field image capabilities of the transducer are maximized. Moreover, the spatial drop in sensitivity caused by the spatial taper of the relaxor or electrorestrictive layer also helps reduce side lobes.

An increase in the bias voltage increases the effective elevation aperture of the transducer to provide a beam represented by lines 58. The depth of penetration into a medium of interest is increased. Additional increases in depth are provided by further increases to the bias voltage, as represented by lines 60 and lines 62.

In operation, the applied bias voltage may be fixed during an imaging process. However, in a preferred embodiment, the operation is one in which the bias voltage is varied over a single imaging procedure or frame. For example, the four beams represented in FIG. 11 may be generated during an interrogation of human tissue, with the results being combined to form a single image. In this manner, an improved gray scale image can be provided, as compared to an image formed by an ultrasonic transducer having a fixed beam diameter.

Figure 13:
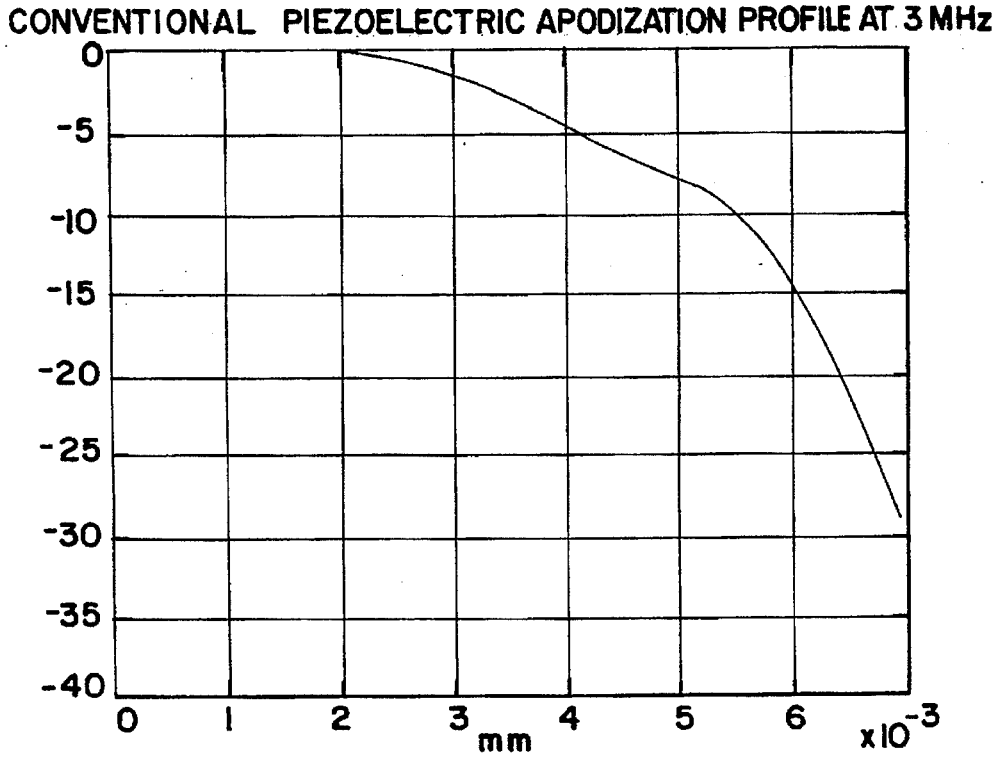
FIG. 13 (PRIOR ART)
FIG. 13 is a graph illustrating the apodization profile for a prior art transducer formed according to the '175 or '998 patent operated at 3 MHz.
Figure 14:
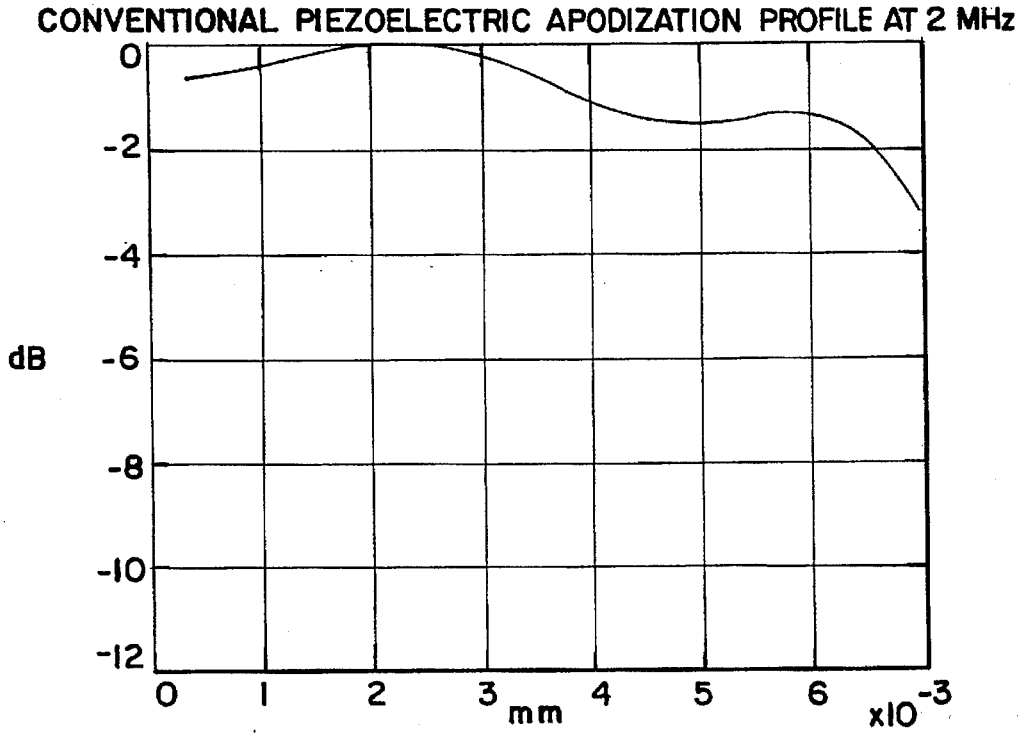
FIG. 14 (PRIOR ART)
FIG. 14 is a graph illustrating the apodization profile for a prior art transducer formed according to the '175 or '998 patent operated at 2 MHz.

As previously described, U.S. Pat. Nos. 5,415,175 and 5,438,998 disclose a transducer element formed of piezoelectric material such as PZT having a plano-concave shape. Due to the variable thickness, the transducer response has a natural apodization along elevation even when it is made with PZT. FIGS. 13 and 14 show the apodization profiles calculated for such a transducer designed to operate at 3 and 2 MHz respectively.

Estimates were made to find out how the apodization might be improved by replacing the piezoelectric material with a relaxor ferroelectric material such as PMN-PT and by using an applied bias voltage, as described above. To make such estimates it was assumed that each point along the elevation of the transducer element receives additional apodization by the bias voltage according to a curve shown in FIG. 15, which is reproduced from an article by Takeuchi et al. entitled "Medical Ultrasonic Probe Using Electrorestrictive—Ceramics/Polymer Composite," printed in the IEEE 1989 Ultrasonics Symposium at pages 705–708. The apodization level was estimated by multiplying the natural apodization shown in FIGS. 13 and 14 with the bias-dependent factor from FIG. 15.

Figure 16:
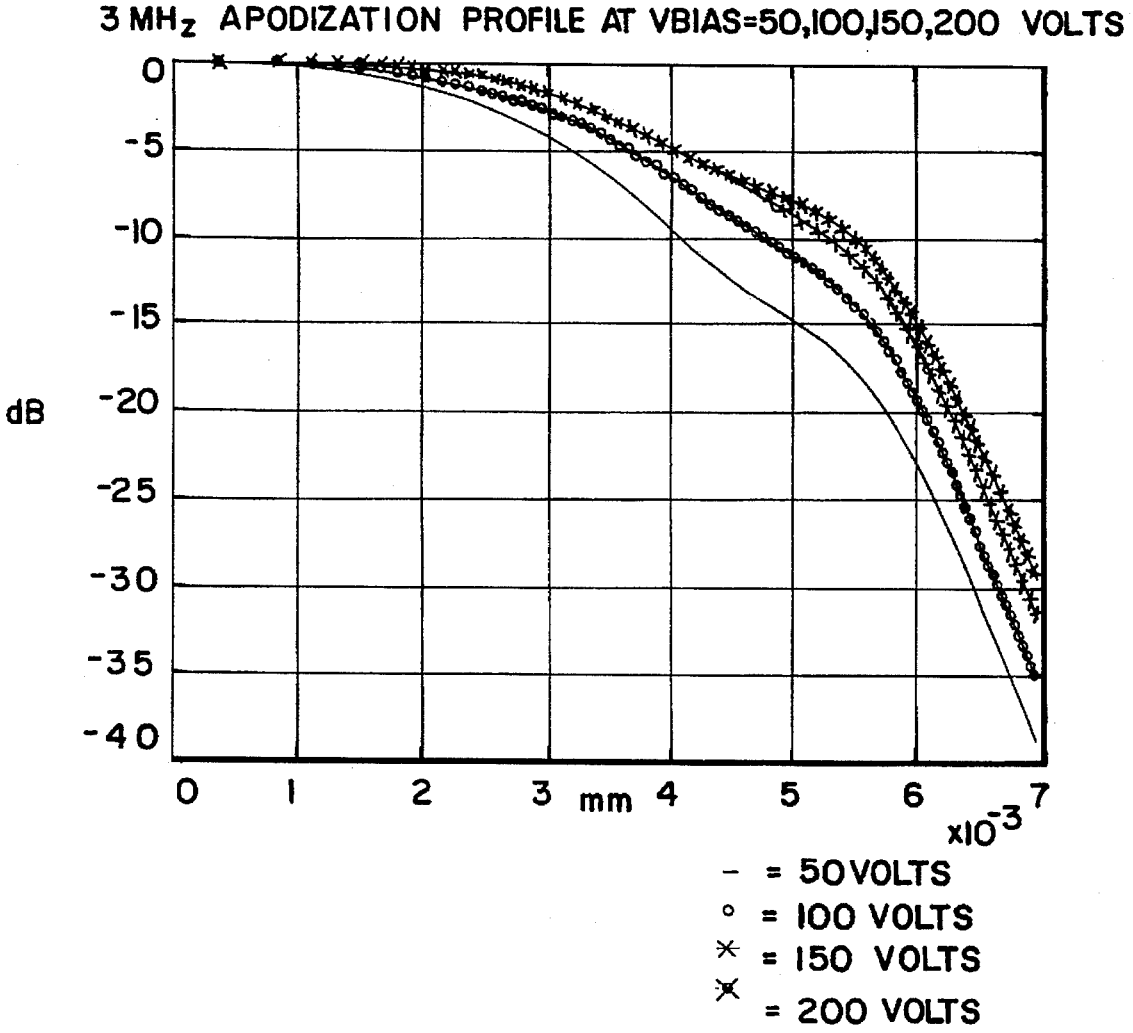
FIG. 16 is a graph estimating the apodization profiles for a transducer formed according to the '175 or '998 patent operated at 3 MHz for various applied bias voltages wherein the transducer elements are formed of a relaxor material.
Figure 17:
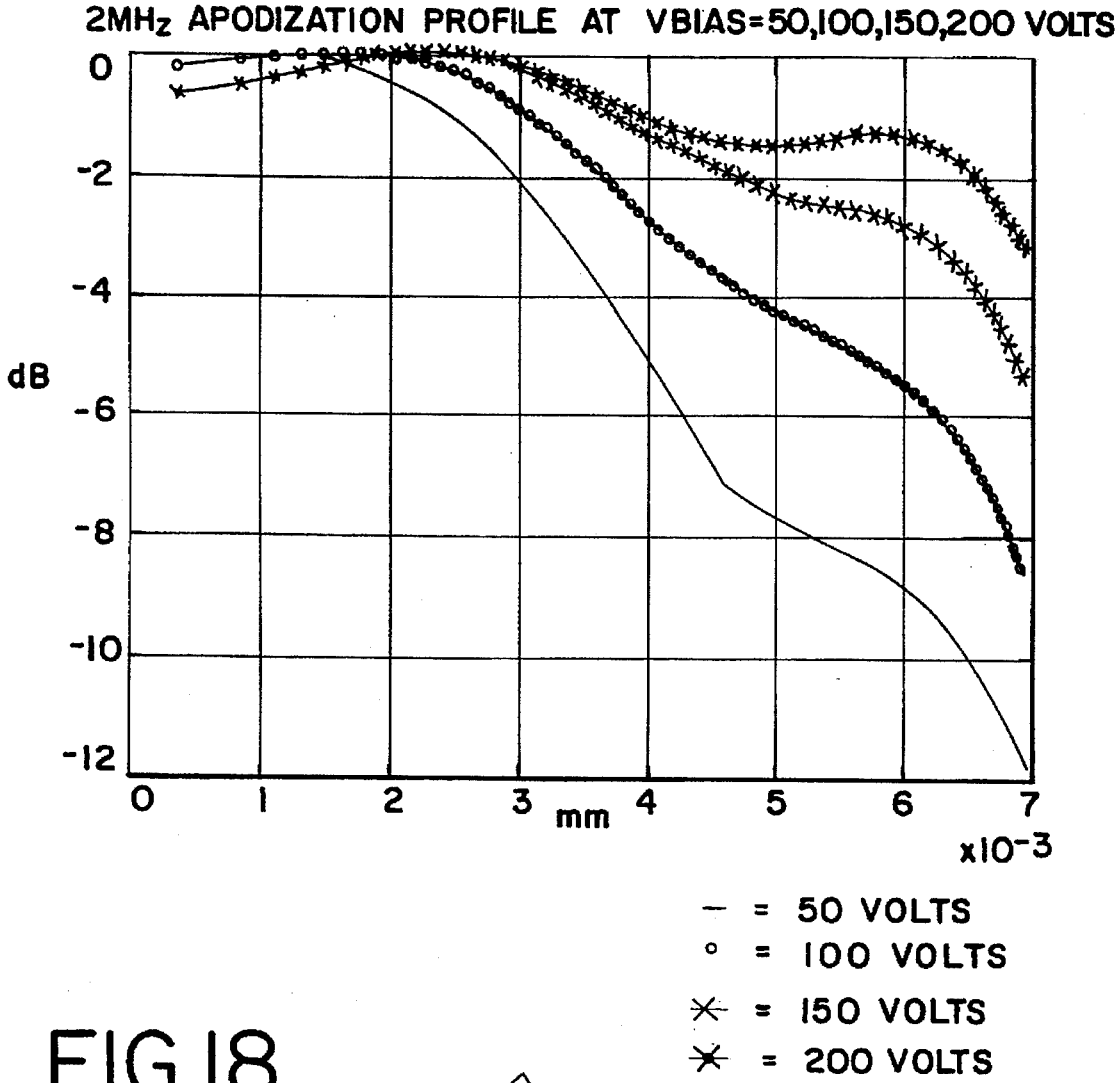
FIG. 17 is a graph estimating the apodization profiles for a transducer formed according to the '175 or '998 patent operated at 2 MHz for various applied bias voltages wherein the transducer elements are formed of a relaxor material.

FIG. 16 is a graph estimating the apodization profiles for a transducer formed according to the '175 or '998 patent operated at 3 MHz for a plurality of applied bias voltages wherein the transducer elements are formed of a relaxor material. FIG. 16 is a graph estimating the apodization profiles for a transducer similar to the one described with reference to FIG. 16 operated at 2 MHz. In both FIGS. 15 and 16 the estimates are made for a bias voltage of 50, 100, 150, 200 volts.

According to these estimates, undesirable dips in the apodization profile for a transducer formed of a piezoelectric material would be reduced by the use of a relaxor material as shown in the graphs.

Figure 18:
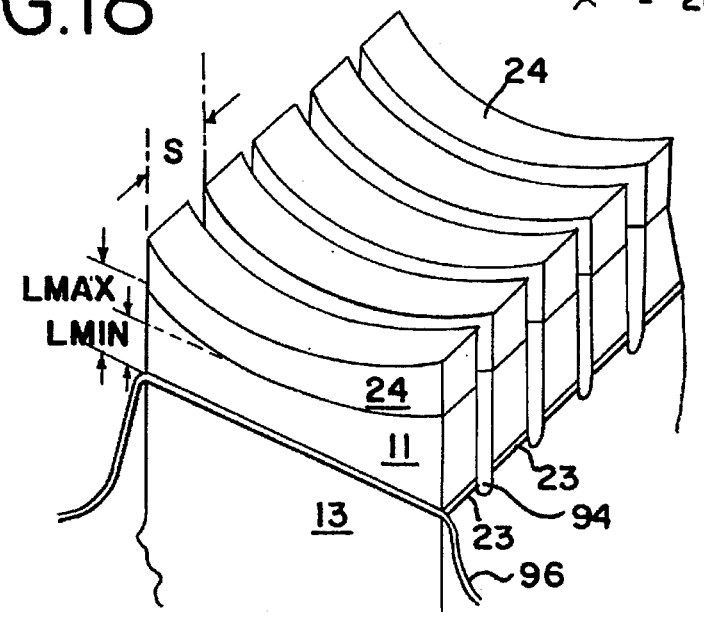
FIG. 18 is a perspective view of a transducer assembly according to a preferred embodiment of the present invention.

FIG. 18 is a perspective view of a transducer array according to a preferred embodiment of the present invention. A number of electrically independent relaxor ferroelectric elements 11 may then be formed by dicing kerfs 94 as is commonly done in the industry. The kerfs 94 result in a plurality of matching layers 24, relaxor ferroelectric elements 11, and electrodes 23. The kerf may also slightly extend into the backing block 13 to ensure electrical isolation between transducer elements.

After the kerfs 94 have been diced, a ground electrode (not shown) can be deposited on the front surface of the matching layer. In order for there to be an electrical connection between the ground electrode and the layer of relaxor material, preferably the matching layer is plated on all sides.

As is well known in the art, the individual elements forming the transducer may be glued together by use of an epoxy material. A Hysol® base material number 2039 having a Hysol® curing agent number HD3561 which is manufactured by Dexter Corp., Hysol Division of Industry, California may be used for gluing the various materials together. The entire assembly is then preferably housed in a nose piece (not shown).

It is to be understood that the forms of the invention described herein are to be taken as preferred examples and that various changes in shape, size and arrangement of parts may be made without departing from the spirit of the invention or scope of the claims.

What is claimed is:

1. An ultrasonic transducer comprising:

a layer of material having an electromechanical coupling coefficient, said material having a front surface and a back surface and a layer thickness, said layer thickness defined as the distance perpendicular to an elevational axis between said front surface and said back surface, said layer thickness at a first point on said front surface being less than the layer thickness at a second point on said front surface, said front surface facing a medium of interest when said transducer is in use wherein said electromechanical coupling coefficient of said material increases with an increase of bias field applied thereto.

2. The transducer according to claim 1 further comprising a source of bias voltage coupled to said layer of material.

3. The transducer according to claim 1 wherein said layer of material is an electrorestrictive.

4. The transducer according to claim 1 wherein said layer of material is a relaxor ferroelectric.

5. The transducer according to claim 1 wherein said front surface is generally concave in shape.

6. The transducer according to claim 1 wherein said layer thickness increases away from a center region of said layer.

7. The transducer according to claim 5 wherein said back surface is generally planar.

8. The transducer according to claim 1 wherein said layer thickness has a minimum value substantially at said center region of said layer.

9. The transducer according to claim 8 further comprising a curved acoustic matching layer positioned between said front surface and a region of examination.

10. The transducer according to claim 9 further comprising a coupling element having acoustic properties similar to an object to be examined in said region of examination, said coupling element disposed on said matching layer.

11. The transducer according to claim 2 wherein said source of bias voltage is adjustable to change an elevational aperture of said transducer and vary penetration depth into said medium of interest and beam characteristics of an acoustic wave.

12. The transducer according to claim 4 wherein said relaxor ferroelectric material is selected from the group consisting of lead magnesium niobate, lead magnesium niobate-lead titanate, lanthanum-doped lead zirorate titanate, barium strontium titanate and mixtures thereof.

13. A method for controlling an elevational aperture of an ultrasonic transducing device, the method comprising the steps of:

providing a layer of relaxor ferroelectric material having an electromechanical coupling coefficient that increases with an increase of bias field applied thereto, said material having a first side and a second side opposite to said first side, said layer increasing in thickness with departure from a central region of said first side;

providing electrodes on said first and second sides of said layer of relaxor ferroelectric material;

aiming said transducing device at a medium of interest wherein said first side faces said medium of interest;

applying a bias voltage across said layer;

transmitting acoustic waves from said transducing device into said medium of interest by applying an excitation signal across said layer; and selectively changing said bias voltage to change an elevation aperture of said transducing device and thereby vary the penetration depth into said medium of interest and beam characteristics of said acoustic waves.

14. A device for transmitting and receiving acoustic waves, said device comprising:

a transducer having a layer of relaxor ferroelectric material having an electromechanical coupling coefficient that increases with an increase of bias field applied thereto, said layer having a first side and a second side opposite of said first side, said layer of relaxor ferroelectric material increasing in thickness with departure from a central region of said first side;

a first electrode coupled to said first side of said layer of relaxor ferroelectric material;

a second electrode coupled to said second side of said layer of relaxor ferroelectric material;

a first source of excitation signal connected to said first and second electrodes; and a second source of a biasing voltage connected to said first and second electrodes wherein said transducer has an effective elevation aperture that varies in response to changes in said biasing voltage.

15. The device according to claim 14 wherein said layer of material comprises an electrorestrictive.

16. The device according to claim 14 wherein said layer of material comprises a relaxor ferroelectric.

17. The device according to claim 16 wherein said layer of relaxor ferroelectric material is selected from the group consisting of lead magnesium niobate, lead magnesium niobate-lead titanate, lanthanum-doped lead zirorate titanate, barium strontium titanate and mixtures thereof.

18. The device according to claim 14 wherein said second source of biasing voltage comprises an adjustable DC supply.

19. The device according to claim 14 wherein said first side of said layer of relaxor ferroelectric material is concave in shape.

* * * * *

UNITED STATES PATENT AND TRADEMARK OFFICE

CERTIFICATE OF CORRECTION

PATENT NO. : 5,657,295
DATED : August 12, 1997
INVENTOR(S) : Samuel M. Howard

It is certified that error appears in the above-identified patent and that said Letters Patent is hereby corrected as shown below:

In column 3, line 51, replace "bean" with --beam--.

In column 5, line 43, immediately after "$O_3$" insert --)--.

In column 5, line 46, immediately before "$T_1$" insert --(--.

Signed and Sealed this

Twenty-ninth Day of June, 1999

*Attest:*

*Attesting Officer*

Q. TODD DICKINSON

*Acting Commissioner of Patents and Trademarks*